US006109074A

United States Patent [19]

Du

[11] Patent Number: 6,109,074

[45] Date of Patent: Aug. 29, 2000

[54] SHACKLE LOCK

[76] Inventor: Weiqiang Du, No. 12, Yongchang Road Central, Rongli District, Shunde, Guangdong, China

[21] Appl. No.: 09/232,803

[22] Filed: Jan. 19, 1999

[30] Foreign Application Priority Data

Jan. 20, 1998 [CN] China ..... 98233636

[51] Int. Cl.[7] ..... E05B 73/00

[52] U.S. Cl. ..... 70/18; 70/58; 70/49

[58] Field of Search ..... 70/14, 18, 19, 70/30, 49, 38 A–38 C, 57, 58

[56] References Cited

U.S. PATENT DOCUMENTS

| | | | |
|---|---|---|---|
| 3,101,695 | 8/1963 | Honeyman et al. | 70/58 X |
| 3,696,647 | 10/1972 | Balicki | 70/49 |
| 3,738,132 | 6/1973 | Nagel | 70/49 |
| 4,028,916 | 6/1977 | Pender | 70/233 |
| 4,055,973 | 11/1977 | Best | 70/58 |
| 4,212,175 | 7/1980 | Zakow | 70/58 |
| 4,325,238 | 4/1982 | Scherbing | 70/18 |
| 4,570,465 | 2/1986 | Bennett | 70/18 |
| 5,154,072 | 10/1992 | Leyden | 70/18 |
| 5,177,986 | 1/1993 | Jensen | 70/18 |
| 5,181,402 | 1/1993 | Faessler et al. | 70/18 |
| 5,398,530 | 3/1995 | Derman | 70/58 |
| 5,440,904 | 8/1995 | Su | 70/18 |
| 5,475,993 | 12/1995 | Kuo | 70/18 |
| 5,505,064 | 4/1996 | Wang | 70/53 |

FOREIGN PATENT DOCUMENTS

| | | | |
|---|---|---|---|
| 7540 | 1/1979 | Germany | 70/49 |

*Primary Examiner*—Suzanne Dino Barrett
*Attorney, Agent, or Firm*—Harold L. Novick; Nath & Associates

[57] ABSTRACT

A shackle lock having a shackle with at least two ends and whose length can be adjusted, a lock body, and a lock stud is disclosed. One end of the shackle is secured to the lock body and secured at another end to the lock stud. The lock body has at least one insertion hole, and the shackle lock also has at least one intermadiate shackle lock stud which is connected in between two ends of the shackle. The effective shackle length can be adjusted easily so as to be used both as a large size shackle lock and as a small size shackle lock.

7 Claims, 2 Drawing Sheets

SHACKLE LOCK

FILED OF THE INVENTION

The present invention relates generally to a shackle lock, and more particularly to a shackle lock whose shackle length can be adjusted.

BACKGROUND OF THE INVENTION

The prior art shackle lock is generally composed of a lock body and a shackle. The shackle is engaged at both ends thereof with two insertion holes of the lock body. However, the length of the shackle is fixed, a large size shackle lock may have too long shackle to carry and deposit. The Chinese Patent ZL95213338 disclosed a shackle lock having two shackles. However, the connection point of the two shackles are secured to the lock body, the two shackles are unlocked or locked simultaneously when unlocking or locking. Therefore, it is still not convenient for carrying and depositing.

SUMMARY OF THE INVENTION

The primary objective of the present invention is to provide a shackle lock whose shackle length can be easily adjusted.

In accordance with the invention, there is provided a shackle lock, comprising a shackle, a lock body and a lock, wherein the said shackle is secured at one end thereof with the said lock body and secured at the other end thereof with the said lock stud; the said lock body having at least one insertion hole; and the said shackle lock further comprising at least one intermediate shackle lock stud which is connected in between the two ends of the said shackle;

In operation, the effective shackle length becomes maximum when the lock stud is inserted into the insertion hole of the lock body, leaving the intermediate lock studs laid-up. While the effective shackle length will be reduced if both the lock stud and the intermediate lock studs are inserted into the insertion holes respectively, or only some of the intermediate lock studs are inserted. The extent of reduction of the effective shackle length depends on the position where the intermediate lock stud is located. The closer the intermediate lock stud is located relative to the secured end of the shackle, the smaller the effective shackle length will be.

DETAILED DESCRIPTION OF THE PREFERRED EMBODIMENT

Figure 1:
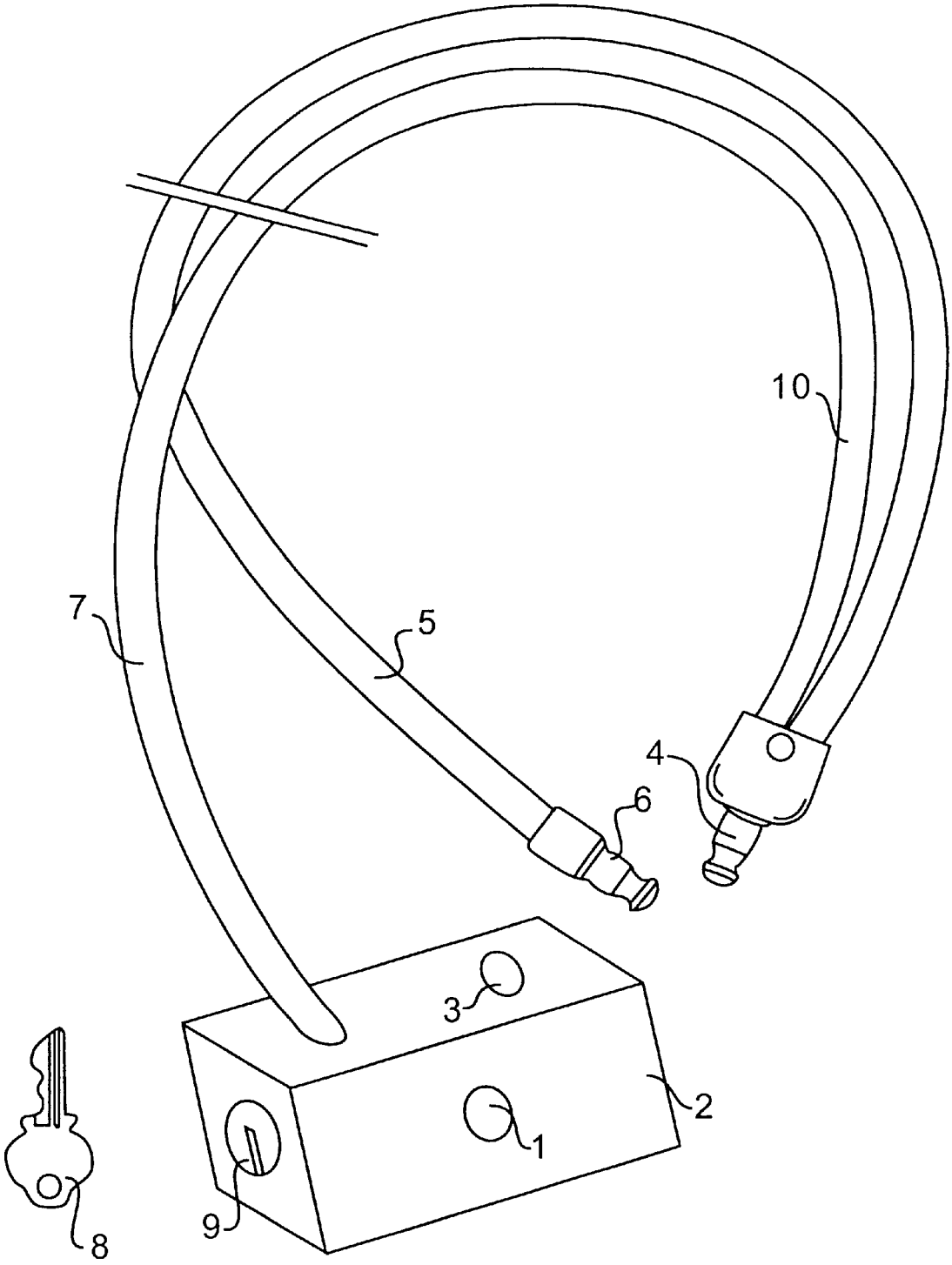
FIG. 1 is the schematic diagram of a preferred embodiment in accordance with the present invention.

Referring to FIG. 1, a shackle lock in accordance with the present invention comprises a shackle 10, a lock body 2 and a lock stud 6. The said shackle 10 is secured at one end thereof with the said lock body 2 and secured at the other end thereof with the said lock stud 6. The said lock body 2 comprises insertion hole 1 and hole 3. When the corresponding intermediate lock stud 4 and the lock stud 6 are inserted respectively into the holes, the lock can be locked or unlocked by the way of the prior art, inserting the key 8 into the lock core 9 of the lock body 2. The shackle 10 is folded at the mid point, forming two shackles, i.e., shackle 5 and shackle 7. At the said folding point, an intermediate lock stud 4 is connected, which is engageable with both insertion hole 3 and hole 1. Since the intermediate lock stud 4 is secured at the mid point of the shackle 10, the two shackles 5 and 7 are approximately the same in length. Therefore, the effective shackle length has two options, the smaller length is 50% as long as the bigger one. Although the best example of this invention is described as above, there are may be numerous changes in the construction. The shackle lock may further comprises multiple shackles 10. The intermediate lock stud 4 may be connected at any point of the shackle 10, or multiple intermediate lock studs 4 may be connected in serial in between the two ends of the shackle 10, so as to form multiple options of effective shackle length.

In the said preferred example, the intermediate lock stud 4 is connected at the folding point of shackles 5 and 7, the free end of shackles 5 and 7 is secured with the lock stud 6 and lock body 2 respectively, therefore, the effective shackle length becomes maximum when the lock stud 6 is inserted into the insertion hole 3, leaving the intermediate lock stud 4 laid-up. While the effective shackle length will be half of the maximum length when the lock stud 6 is inserted into the hole 3 and the intermediate lock stud 4 is inserted into the hole 1 respectively. The shackle lock in accordance with the present invention can be so adjusted to be used both as a large size shackle lock and a small size one.

Figure 2:
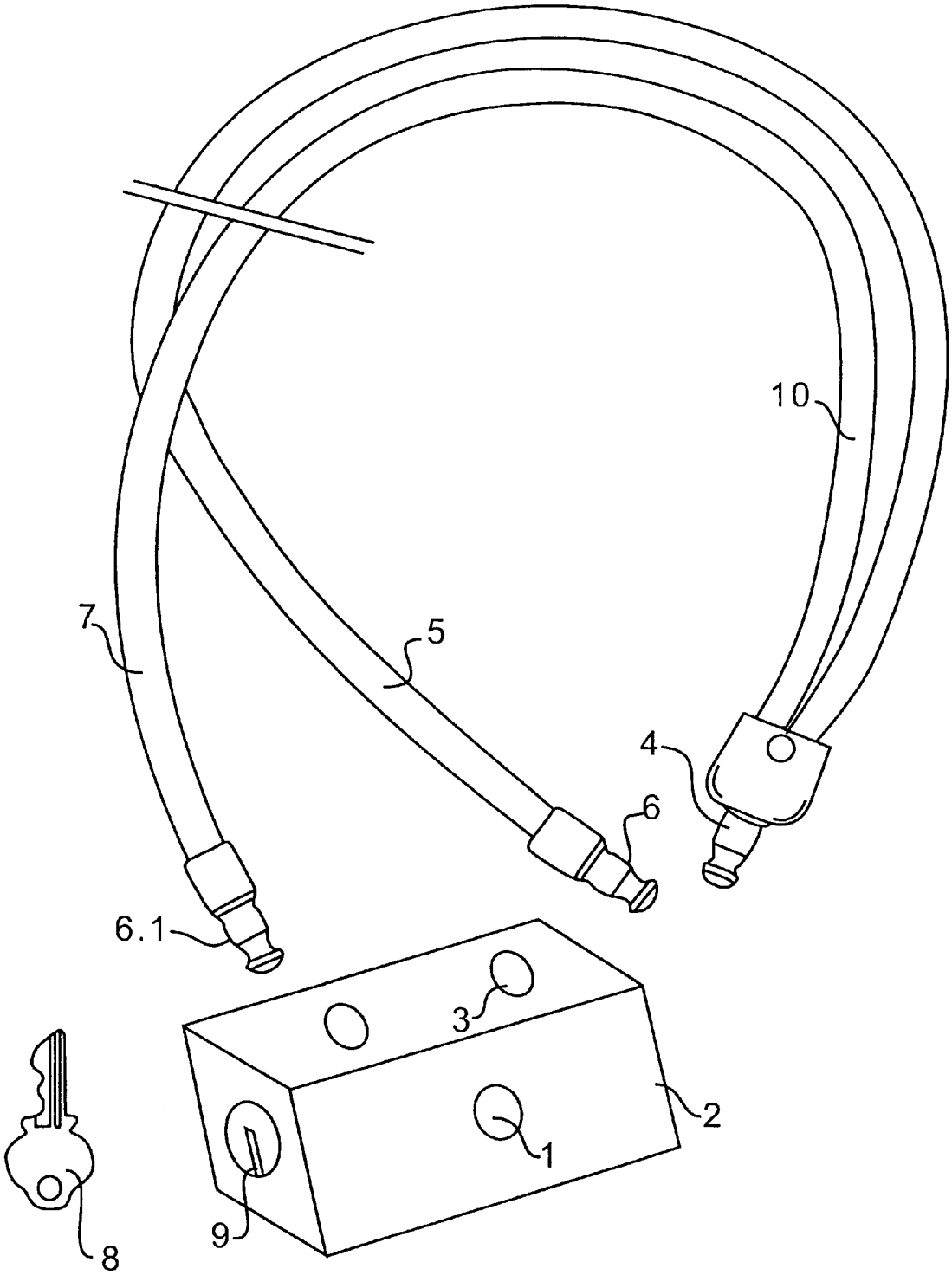
FIG. 2 is the schematic diagram of another preferred embodiment of the present invention

Referring to FIG. 2, in another preferred embodiment of the present invention, the two ends of the shackle 10 are secured with the lock stud 6 and 6.1 respectively, therefore, both ends of the shackle 10 are removeably engageable with the lock body 2.

What is claimed is:

1. A shackle lock, comprising a shackle having at least two ends, a lock body, and at least two lock studs, wherein a first one of the at least two ends of said shackle is secured to a first one of said at least two lock studs, and a second one of the at least two ends of the shackle is secured to a second one of the at least two lock studs;

said lock body having two or more insertion holes; and said shackle lock further comprising one or more intermediate shackle lock studs which is connected in between the at least two ends of the said shackle;

wherein the first one of the at least two lock studs can be engaged with a first one of the two or more insertion holes; and wherein an effective length of the shackle can be adjusted by selectively engaging the second one of the at least two lock studs secured with the second one of the at least two ends of the said shackle or one of said one or more intermediate shackle lock studs with a second one of said two or more insertion holes.

2. The shackle lock as claimed in claim 1, wherein said shackle further comprises multiple shackle segments.

3. The shackle lock as claimed in claim 1, wherein the second one of the at least two lock studs secured with the second one of the at least two ends of the said shackle and at least one of said one or more intermediate shackle lock studs can be engaged with at least one of said two or more insertion holes of said lock body.

4. The shackle lock as claimed in claim 1, wherein a total of the number of said at least two lock studs added to a total of the number of said one or more intermediate shackle lock studs is in accordance with that of the said insertion holes of the said shackle lock, so that when all of the at least two lock studs and one or more intermediate shackle lock studs are engaged with the two or more inserrtion holes, multiple shackle loops can be formed.

5. The shackle lock as claimed in claim 1, wherein at least one of said one or more intermediate shackle lock studs is connected at a midpoint of said shackle thereby defining two coelongate shackles.

6. The shackle lock as claimed in claim 1, wherein said two or more insertion holes further comprises three insertion holes.

7. The shackle lock as claimed in claim 1, wherein said two or more insertion holes further comprises four insertion holes.

* * * * *